US006420944B1

(12) United States Patent
Costa et al.

(10) Patent No.: US 6,420,944 B1
(45) Date of Patent: Jul. 16, 2002

(54) ANTENNA DUPLEXER IN WAVEGUIDE, WITH NO TUNING BENDS

(75) Inventors: Mario Costa, Albate; Roberto Ravanelli, Martesana, both of (IT)

(73) Assignee: Siemens Information and Communications Networks S.p.A., Milano (IT)

( * ) Notice: Subject to any disclaimer, the term of this patent is extended or adjusted under 35 U.S.C. 154(b) by 0 days.

(21) Appl. No.: 09/508,815

(22) PCT Filed: Sep. 11, 1998

(86) PCT No.: PCT/EP98/05864

§ 371 (c)(1),
(2), (4) Date: Apr. 7, 2000

(87) PCT Pub. No.: WO99/16146

PCT Pub. Date: Apr. 1, 1999

(30) Foreign Application Priority Data

Sep. 19, 1997 (IT) ..... MI97A2134

(51) Int. Cl.[7] ..... H01P 5/12; H01P 1/20

(52) U.S. Cl. ..... 333/137; 333/208

(58) Field of Search ..... 333/132, 135, 333/137, 203, 208

(56) References Cited

U.S. PATENT DOCUMENTS 4,990,870 A * 2/1991 Reindel ..... 333/208

FOREIGN PATENT DOCUMENTS

JP A604305 1/1985

OTHER PUBLICATIONS

Dittloff et al, Rigorous Fiels Theory Design Of Millimeter Wave E Plane Integrated Circuit Multiplexers, Feb. 1989, IEEE Transactions on Microwave Theory and Techniques vol. 37 No. 2 pp. 340–350.*

Dittloff et al., IEEE Transactions on Microwave Theory and Techniques, vol. 36, No. 12, pp. 1833–1840 (1988).

Joachim Dittloff et al, "Computer–Aided Design of Slit–Coupled H–Plane T–Junction Diplexers with E–Plane Metal–Insert Filters", IEEE Transactions on Microwave Theory and Techniques, vol. 36, No. 12, Dec., 1988, pp. 1833–1840.

Joachim Dittloff et al, "Rigorous Field Theory of Design of Millimeter–Wave–E–Plane Integrated Circuit Multiplexers", IEEE Transactions on Microwave Theory and Techinques, vol. 37, No. 2, Feb., 1989, pp. 340–350.

Fritz Arndt et al, "Theory and Design of Low–Insertion Loss Fin–Line Filters", IEEE Transactions on Microwave Theory and Techniques, vol. MTT–30, No. 2, Feb., 1982, pp. 155–162.

* cited by examiner

*Primary Examiner*—Robert Pascal
*Assistant Examiner*—Kimberly E Glenn

(57) ABSTRACT

An antenna duplexer including an elongated hollow body realized with two opposed half shells is disclosed. The duplexer also includes a first opening or antenna port and a second and a third opening, or ports of the transmitter and of the receiver. A filtering structure is provided including a plurality of metal inserts available to uncouple the transmitter from the receiver. The duplexer has at least an additional portion of waveguide structured in order to keep the wave "under the cut-off frequency", interposed between at least second or third opening and the relative end wall of the elongated body. An additional portion of wave guide includes an additional metal insert, forming part of the above mentioned filtering structure, which determines an exponential attenuation of the signal, thus nullifying the negative effects deriving from the mechanical tolerance of the hollow body.

12 Claims, 1 Drawing Sheet

ANTENNA DUPLEXER IN WAVEGUIDE, WITH NO TUNING BENDS

This application is the national phase under 35 U.S.C. § 371 of PCT International plication No. PCT/EP98/05864 which has an International filing date of Sep. 11, 1998, which designated the United States of America.

FIELD OF THE INVENTION

The present invention relates to a particular "no tuning" filtering structure in rectangular wave guide with bends, for the connection of an antenna to a transmitter and a receiver. In the specific technique, the filtering structure is identified by the term "antenna duplexer" and in particular it is in a device enabling the simultaneous use of a same antenna both by the transmitting and by the receiving equipment. In general, the operating frequency of the transmitting equipment differs from the operating frequency of the receiving equipment.

It is known that antenna duplexers for radio links, generally include a rectangular wave guide having three opening sides or ports. A band pass filter is associated with each one of the two side ports. The band pass filters are tuned to the transmitter and receiver operating frequency, respectively. A "T" junction is associated with the central port (or antenna port), so that a side port and the antenna port are electrically matched, for example, on a first frequency band coinciding with the operating band of the transmitter. The other side port and the antenna port are matched on a second frequency band coinciding with the operating band of the receiver.

Therefore, the subject duplexer has the function to convey the received signals from the antenna towards the receiver and also to send the transmitted signals to the antenna.

In particular, duplexers with bends are configured in such a way to have two mentioned side ports above on a side of the guide, thus enabling a considerable reduction of the overall dimensions of the whole transmission system.

Band-pass filters, in a rectangular wave guide, are usually made by resonant cavities inside the guide, which are coupled among them through physical discontinuities obtained inside the guide itself.

A type of discontinuities used to implement these band pass filters, is a series of thin traverse metal inserts (the relative filters are therefore identified by the name "metal insert" filters) that cross some portions of the cavity of the wave guide. The filtering characteristics are determined by the length of the metal inserts and by the distance between the metal inserts. Therefore, it is clear that to obtain the best filtering characteristics, the accuracy in the realization and the positioning of the metal inserts inside the wave guide are of particular importance.

BACKGROUND OF THE INVENTION

This accuracy of realization and assembling is obtained by manufacturing the metal inserts in one piece only, with a rectangular frame inserted in the wave guide along the longitudinal midplane parallel to the wall where the opening sides are located. The wave guide is subdivided into two half shells. The rectangular frame including a plurality of inserts and openings is placed between the two half shells. The plurality of inserts and openings behave as resonant cavities placed in such a way so as to perform the desired filtering function.

It must be considered that the above mentioned rectangular frame can be manufactured through highly accurate mechanical techniques, such as for example electroerosion and the like. These manufacturing technologies achieve an accuracy in the range of microns, which is an accuracy higher than the allowable margin of error. The allowable margin of error is in the range of a hundredth of millimeter.

Metal insert filters and multiplexers are disclosed in the following references:

IEEE Transaction Microwave Theory and Techniques vol. 37 No 2 February 1989 "Rigorous Field Theory Design of Millimeter Wave E-plane Integrated Circuit Multiplexers.", by Joachin Dittlof, Fritz Arndt.

IEEE Transaction Microwave Theory and Techniques vol. 36 No 12 December 1988, "Computer Aied Design of Slit Coupled H-Plane T-junction diplexers with EPlane Metal Insert Filters." by Joachin Dittlof, Fritz Arndt.

IEEE Transaction Microwave Theory and Techniques vol. MTT 30 No 2 February 1982, "Theory and Design of Low Insertion Loss Fin Filters." by J. Bornemann, Fritz Arndt.

However, none of the above-noted references disclose a duplexer with bends.

In known duplexers with bends, the ending parts of the internal cavities of the wave guide close on a short circuit, made of the end walls of the wave guide itself.

It must be considered that the bend is electrically matched only if the above mentioned short circuit is placed at a well defined distance from the axis of the relative side port. This result will be more clear hereafter, by making reference to FIG. 2.

However, it must be kept in mind that the end walls of the wave guide are made through traditional mechanical working, such as for example milling operations and even using high accuracy numeric control equipment it is not possible to obtain the accuracy required for the subject applications which, as said above, must be in the range of a hundreth of millimeter.

A recurring problem of known duplexers is the difficulty to space the above mentioned end wall of the guide with the required accuracy from the axis of the relative port. Another technical problem is to compensate the negative effects derived from the bending radius of the mill itself. Although a small size can be used, it always cause a working radius between the internal walls of the cavity forming the wave guide itself.

These working tolerances negatively alter the filtering characteristics of the signal inside the wave guide, particularly in relation to the portion of the cavities adjacent to an end wall that is used as resonator. In fact, in these conditions the working error of the mill highly influences both the tuning frequency of the bend (it is a problem for the electrical bend matching) and the frequency tuning of the above mentioned filter (when the last cavity of the filter actually coincides with the bend itself).

In conventional designs tuning screws are generally employed, that are allowed to penetrate at least in part the wave guide. Through adjustment of the penetration depth it is possible to compensate for the negative effects derived from the above mentioned working tolerance. However, it must be kept in mind that the presence of these screws involves the introduction of a tuning step in the production process and consequently the addition of a non negligible cost item.

SUMMARY OF THE INVENTION

It is an object of the invention to overcome the disadvantages of the prior art by implementing a duplexer whose filtering characteristics are not affected by the mechanical tolerance of the working of the internal cavities of the guide itself, so that it is possible to avoid the use of the mentioned tuning screws and realize a so-called "no tuning" duplexer.

The above object is solved by the combination of features of the present invention.

Therefore, considering that in known type duplexers with bends the two end walls of the wave guide form a short circuit, an embodiment of the invention comprises closing the cavity on a inductive load instead of on a short circuit. In particular, the inductive load is realized through the insertion in at least one end of the guide of an additional section of guide, "under the cut-off frequency", in which the size of the guide does not enable the signal propagation.

According to aspects of the invention these guide sections are realized through insertion in the guide of a metal insert, essentially identical in thickness and position to that used in making the filter mentioned above.

It is evident that if the additional metal insert is made during the manufacturing process of the metal inserts forming part of the filtering structure mentioned above, and in particular if a unique frame is realized, including both the metal inserts of the filtering structures and the additional metal inserts forming the above mentioned inductive load, it is possible to take advantage of the benefits derived from the use of the electroerosion process to nullify the negative effects derived from the mechanical tolerance related to the above mentioned milling operation.

Actually in these sections of guide "under the cut-off frequency", the signal has an exponentially attenuation in its propagation from the relative side port towards the end walls or short-circuit. Once the signal has reached (highly attenuated) the end walls, it is reflected and has an additional exponential attenuation during propagation in the opposite direction. The negative effects derived from the above mentioned working tolerance are more attenuated as the length of the two additional sections of guide "under the cut-off frequency" increases.

The new critical distance to be considered is therefore the one existing between the axis of the port and the above mentioned additional metal insert, which as said above, can be manufactured through electroerosion with a margin of error lower than the maximum accepted one.

Therefore, the advantages derived from the electroerosion technology to electrically match both the above mentioned filter and the bend (i.e., no technological difference exists between filter and bend).

BRIEF DESCRIPTION OF THE DRAWINGS

The invention, together with further objects and advantages thereof, may be understood with reference to the following description, taken in conjunction with the accompanying drawings and in which.

DETAILED DESCRIPTION OF THE INVENTION

Figure 1:
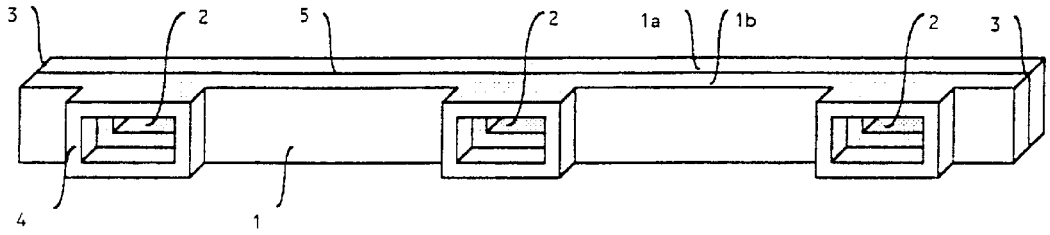
FIG. 1 shows an axonometric view of the wave guide according to the present invention.

Making reference to FIG. 1, the duplexer according to the present invention includes in a known way a hollow body 1 of conductive material having the shape of an elongated parallelepiped. A side wall of such hollow body includes three rectangular openings 2: a central one and two close to each end wall 3. Each opening 2 is preferably surrounded by a rectangular flange 4 used to fasten the antenna to the receiver and the transmitter (not shown in the figures). The hollow body 1 is also divided into two half shells 1*a* and 1*b* along the longitudinal midplane parallel to the side wall on which the openings 2 are located. In this way, during the assembling of the wave guide, it is possible to place between the two half shells 1*a* and 1*b* a thin steel rectangular frame 5 that, according to the invention, has essentially the same length and the same height of the hollow body 1.

Figure 2:
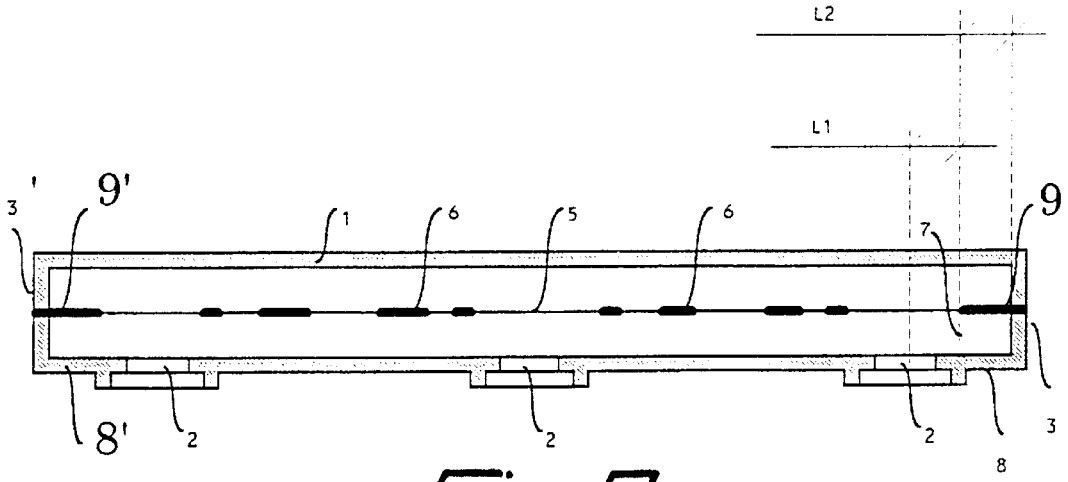
FIG. 2 shows a cross view of the wave guide of FIG. 1.

Making now reference also to FIG. 2, the frame 5 includes in a conventional way a plurality of traverse inserts 6 required to filter the signals transmitted through the wave guide. In particular, FIG. 2 shows ten inserts 6 gathered in two groups of four, which are placed in the two sections of the hollow body 1 among the three openings 2. It is evident that in other embodiments of the duplexer the number and/or position of the inserts 6 can vary according to the filtering characteristics required.

In the conventional type duplexers with bends, the wave guide ends coincide with the dotted line identified with the reference number 7 in FIG. 2.

In this figure, L1 identifies the distance between the axis of any of the two side ports 2 and the dotted line 7. The distance L1 is particularly critical in the known type duplexers with bends for the reasons mentioned above.

On the contrary, the duplexer according to the invention has two additional sections of wave guide "under the cut-off frequency" identified as 8 and 8', respectively, having a length L2. The additional sections of the wave guide are divided by an additional metal insert 9 and 9' protruding from each end wall 3 towards the cavity of the hollow body 1.

The metal inserts 9 and 9' divide the ends of the hollow body 1 in two essentially equal parts, in such a way that the electromagnetic signals transmitted through the wave guide are exponentially attenuated when they reach end walls 3 and 3'.

In order that the presence of inserts 9 and 9' do not interfere with the signal transmitted through the opening sides 2 (placed close to the end walls 3), the end walls of the hollow body 1 are preferably moved away in such a way that the distance of the opening sides 2 from the closer end wall 3 is greater than the length of the metal insert 9 projecting from the end wall itself.

As a result of the presence of the metal foil projecting inside each end wall, the ending portion of the inside cavity of the wave guide closes with an inductive load and not with a short circuit, as in conventional wave guides. The inductive load makes the wave guide less sensitive to the working mechanical tolerances, because the electromagnetic field close to each end wall is exponentially attenuated. Therefore, if the metal insert 9 or 9' is long enough, the electromagnetic field reflected by the short circuit formed by the end wall of the wave guide nullifies before returning into the adjacent cavity to the metal foil itself.

If the two metal inserts 9 and 9' and the rectangular frame comprising the metal inserts 6 performing the filtering function mentioned above are made in one piece, it is possible to space with high accuracy each metal insert from the closer metal insert 6 and to avoid excessive assembling tolerances of the frame between the two half shells of the wave guide that can negatively affect the filtering and transmission characteristics of the invention.

It is evident that in other embodiments of the wave guide according to the present invention the shape of the hollow body, as well as the number of side openings and metal foils projecting from the contiguous enclosure can vary according to the type and number of devices connected to the wave guide itself.

What is claimed is:

1. An antenna duplexer in a wave guide with no tuning bends comprising:

an elongated hollow body having two opposed half shells and forming the above mentioned wave guide;

a first opening located in a central position on a side wall of said elongated hollow body adapted to be coupled to an antenna;

a second opening and a third opening, also located on said side wall of the elongated hollow body, close to end walls of the elongated hollow body, adapted to be coupled to a transmitter and a receiver, respectively; and a rectangular frame comprising a plurality of metal inserts of conductive material, which transversally crosses an inside cavity of the elongated hollow body to form a filtering structure that uncouples the transmitter from the receiver, wherein said antenna duplexer has at least an additional portion of the wave guide placed between at least one of the second and third openings and the relative end wall of the elongated hollow body and wherein an insert of conductive material projects towards the inside cavity that attenuates an electromagnetic signal transmitted through the wave guide in an exponential way to produce a nullification of the same coinciding with the relative end wall.

2. The antenna duplexer according to claim 1, wherein said insert of conductive projecting material is essentially parallel to the side wall of the hollow body on which said openings are formed.

3. The antenna duplexer according to claim 2, wherein said insert of conductive projecting material protruding from the inside of the relative ending wall of the elongated hollow body is formed in one piece with said rectangular frame.

4. The antenna duplexer according to claim 1, wherein the distance between one of the second and third openings and the relative end wall close to the same is greater than the length of the insert protruding from the relative end wall.

5. The antenna duplexer according to claim 1, wherein an additional portion of wave guide "under the cut-off frequency" exists at each end of the elongated hollow body.

6. A wave guide with no tuning bends comprising:

an elongated hollow body having two opposed half shells;

a first opening located in a central position on a side wall of said elongated hollow body;

a second opening and a third opening, also located on said side wall of the elongated hollow body, close to end walls of the elongated hollow body;

a rectangular frame comprising a plurality of metal inserts of conductive material, which transversally crosses an inside cavity of the elongated hollow body to form a filtering structure that uncouples the second opening from the third opening; and at least one additional portion of the wave guide placed between at least one of the second and third openings and the relative end wall of the elongated hollow body, wherein an insert of conductive material projects towards the inside cavity that attenuates an electromagnetic signal transmitted through the wave guide in an exponential way to produce a nullification of the electromagnetic signal coinciding with the relative end wall.

7. The wave guide according to claim 6, wherein said wave guide forms an antenna duplexer.

8. The wave guide according to claim 7, wherein said first opening is connected to antenna, said second opening is connected to a transmitter, and said third opening is connected to a receiver.

9. The wave guide according to claim 6, wherein said insert of conductive projecting material is essentially parallel to the side wall of the hollow body on which said openings are formed.

10. The wave guide according to claim 9, wherein said insert of conductive projecting material protruding from the inside of the relative ending wall of the elongated hollow body is formed in one piece with said rectangular frame.

11. The wave guide according to claim 6, wherein a distance between one of the second and third openings and the relative end wall close to the same is greater than the length of the insert protruding from the relative end wall.

12. The wave guide according to claim 6, wherein an additional portion of wave guide "under the cut-off frequency" exists at each end of the elongated hollow body.

* * * * *